United States Patent [19]

Legille et al.

[11] 4,042,130

[45] Aug. 16, 1977

[54] CHARGING DEVICE FOR SHAFT FURNACE

[75] Inventors: Edouard Legille; Pierre Mailliet, both of Luxembourg, Luxembourg

[73] Assignee: S.A. des Anciens Etablissements Paul Wurth, Luxembourg

[21] Appl. No.: 614,307

[22] Filed: Sept. 17, 1975

[30] Foreign Application Priority Data

Sept. 20, 1975 Luxembourg ..... 70952

[51] Int. Cl.[2] ..... B66C 17/08

[52] U.S. Cl. ..... 214/35 R; 266/183; 193/16; 137/801

[58] Field of Search ..... 214/35 R, 17 C, 17 CB; 266/176, 183; 193/16, 17; 137/615, 801; 251/155

[56] References Cited

U.S. PATENT DOCUMENTS

| | | | |
|---|---|---|---|
| 818,762 | 4/1906 | Hart | 193/16 |
| 3,693,812 | 9/1972 | Mahr et al. | 214/35 R |
| 3,899,088 | 8/1975 | Furuya et al. | 214/35 R |

FOREIGN PATENT DOCUMENTS

| | | | |
|---|---|---|---|
| 2,104,116 | 8/1972 | Germany | 266/27 |

*Primary Examiner*—Albert J. Makay
*Assistant Examiner*—Lawrence E. Williams

[57] ABSTRACT

A rotatable and angularly adjustable charging and distribution device for shaft furnaces, particularly blast furnaces, is presented. A cylindrical or frustoconical distribution spout is suspended at three points which define a plane. The three points of suspension are caused to move longitudinally (i.e. substantially vertically) and synchronously whereby the lateral surface of the distribution spout may be caused to move in a path which is virtually conical without rotating the suspension points about the vertical axis of the furnace. The suspension points may be moved either by delivering a driving force to them or by applying a traction force to them.

37 Claims, 10 Drawing Figures

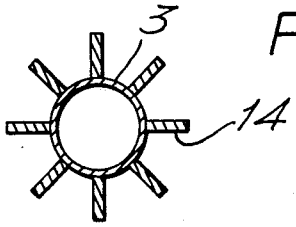
Fig. 1a.
Fig. 1b.
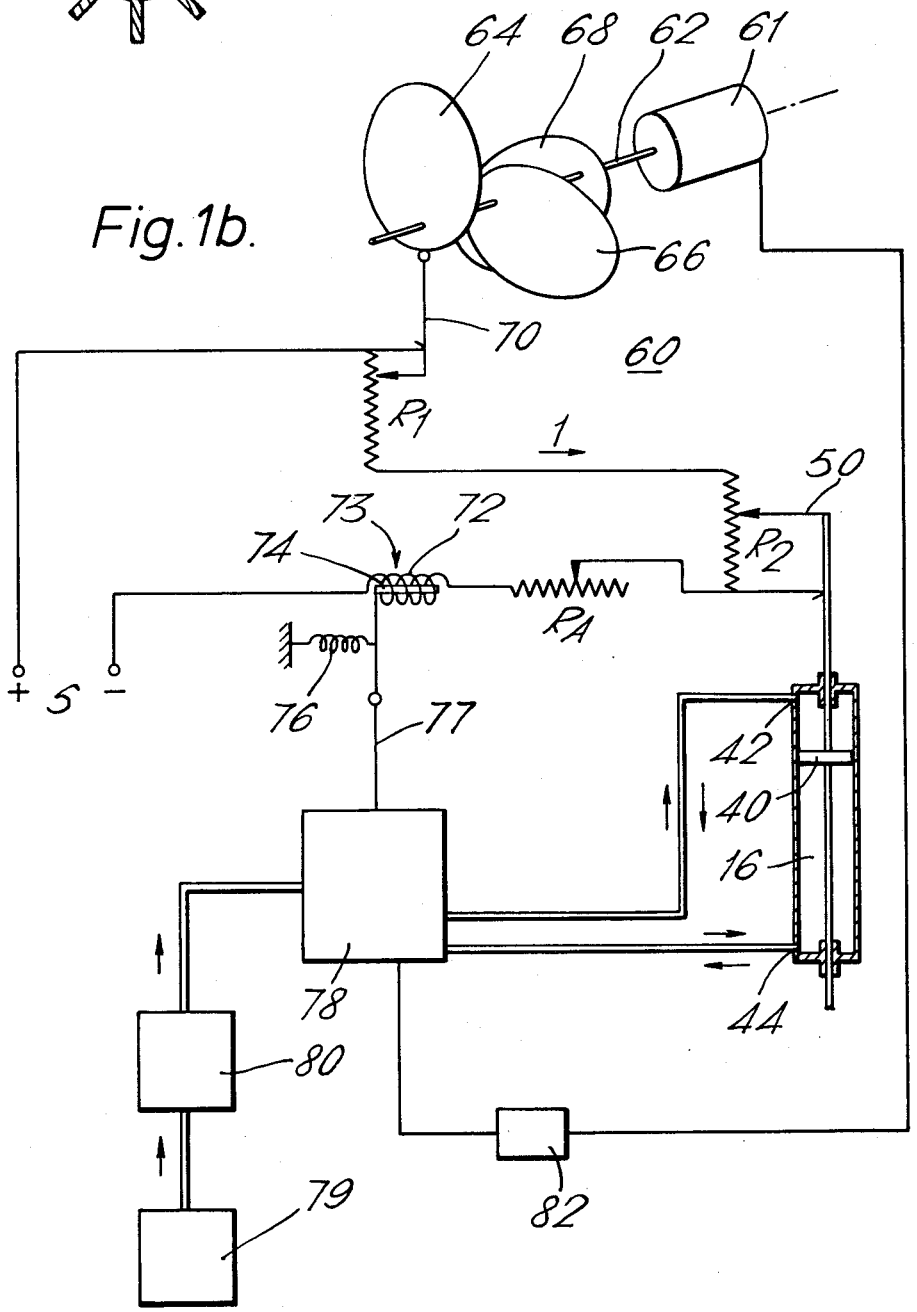

V $S_1^+$
0
t
T1
T2
$S_1^-$
B
A
t1

V $S_2^+$
0
t
$S_1^-$
B
A
t2

V $S_1^+$
0
t
$S_1^-$
B
A 120
122
116
124
126
128
130
132
158
156
152
176
172
180
178
174
148
150
154
160
149
162
134
136
164
170
190
188
194
196
192
198
200
208
206
216
214
210
30
212
28
10
2
168
166
184
186
215
202
204
182
142
140
118
169
146
36
3
34
1
14
12
x

CHARGING DEVICE FOR SHAFT FURNACE

BACKGROUND OF THE INVENTION

The present invention relates to a charging and distribution device for shaft furnaces, particularly blast furnaces. More particularly, this invention relates to a charging and distribution device which comprises a rotary distribution spout adjustable in its angle of inclination and installed inside the throat of a furnace, particularly a high capacity blast furnace operated at high pressures.

Recent developments in the field of high capacity blast furnaces have resulted in increasingly exacting demands on the charging devices employed in such furnaces. One important concept adopted for the purpose of improving the efficiency of such blast furnaces is to try to insure that the throat gas will pass through the furnace charge in the optimum manner. If this object is to be realized in present day blast furnace designs, which attempt to achieve increasing size and higher operating pressures, even distribution of the charging material in the blast furnace is required. Since the configuration with which the charge or burden is distributed over the surface of the hearth of the blast furnace depends directly on the charging device employed, it can easily be understood that the charging device may contribute considerably to the improvement in the efficiency and operation of a blast furnace if it enables the charging operation to be controlled exactly as desired.

Two basic types of charging devices are presently known in the art. The first, which has been in use for many years, employs two superimposed bells of unequal diameter. These bells have to be extremely large if they are to be suitable for and fit large diameter blast furnaces. The size of these bells must increase proportionally with the increase in size of blast furnaces. Such bells represent a substantial investment cost, and they present serious difficulties when they have to be repaired or replaced. Furthermore, when employing such bells it is not possible to introduce the charge in an even and uniform manner over the surface of the blast furnace. As is well known in the art, a hollow is unavoidably formed underneath the lower bell, thus resulting in a characteristic M curve configuration of the charge surface. Thus, the important object of achieving a uniform distribution of the charge or burden cannot be realized when the two bell charging configuration is employed.

The second category of charging devices, which is achieving increased acceptance and use, is a bell-less charging apparatus which operates on the principle of a rotatable and angularly adjustable spout. The spout is rotatable and adjustable to distribute the charge inside the furnace to permit the charging configuration or profile to be controlled as desired. This bell-less charging installation is described in U.S. Pat. No. 3,693,812, and improvements are disclosed in U.S. Pat. Nos. 3,814,403 and 3,880,302. The three above-identified U.S. patents are all assigned to the assignee of the present invention, and reference is hereby made thereto for details of the features disclosed in those patents.

The basic concept of the rotatable and angularly adjustable spout charging device incorporates a pair of storage tanks for holding the charging material, the storage tanks being alternately emptied via an intake chute into a rotatable distribution spout installed in the throat of the blast furnace. The spout is mounted so as to be rotatable about the axis of the blast furnace and angularly adjustable with respect to the axis of the blast furnace so that it can be tilted. The charge configuration can be modified or controlled by varying the rate of rotation and/or the angle of inclination of the charging spout.

The mechanisms which rotate the spout and adjust the angle of inclination of the spout in the above mentioned patents all require two separate control devices to effect rotation and angular displacement of the spout, and they have their control devices partly exposed to furnace throat gas. While these systems have proven to be useful and successful, it is, nonetheless, desired to effect an additional improvement to the rotatable and adjustable charging chute concept as set forth in this invention.

SUMMARY OF THE INVENTION

In accordance with the present invention, a device is provided for driving and controlling the charging and distribution spout of a shaft furnace to rotate and angularly adjust the discharge end of the spout without rotating the suspension system of the spout. Rather than causing the suspension system of the spout to rotate about the axis of the blast furnace to achieve a circular or spiral trajectory motion for the discharge end of the distribution spout, in the present invention the distribution spout is suspended at at least three points, and these points of suspension are synchronously displaced in an approximately vertical direction in a controlled manner. The vertical displacement of the suspension points of the distribution spout causes the lateral surface of the distribution spout to move in a path which is virtually conical.

The distribution spout has a cylindrical or frustoconical lateral surface or shape and a pair of circular bases, i.e., the entrance orifice and exit orifice. The position of the spout at any time will be completely defined if the position of one of the bases is defined. Considering for purposes of discussion the entrance orifice defining base, the base can be defined by three points which determine a plane; and a change in the position of one or more of these three points will be sufficient to change the direction or position of the spout itself. The discharge end of the distribution spout can thus be directed toward any desired point on the charging surface of the blast furnace by longitudinal, i.e. substantially vertical, displacement of the suspension points, and without rotating the discharge spout about its suspension points about the vertical axis of the furnace. The vertical displacement of the suspension points can be accomplished by several suitable mechanisms, either by means of delivering a driving force to the suspension points or by imposing a traction load on the suspension points.

An important distinction to note with respect to the present invention is that it is essential that the distribution spout constitute a closed lateral surface i.e., a tubular member must be employed as distinguished from the spouts of the above-identified U.S. patents in which the lateral wall is generally open in the form of an open chute or gutter. The closed lateral surface feature of the spout of the present invention is necessary in view of the fact that the spout performs a conical or precessional movement about the vertical axis of the furnace, and the charging material is discharged by each of the generatrices of the lateral wall in turn. This required closed shape of the lateral surface, and the action of the charging material in passing over the various parts of the lateral wall in turn, constitute a further advantage from a wear standpoint over the spouts of the above-identified U.S. patents. In those prior patents the same part of the chute surface is always used, and thus is always exposed to friction from the charging material, while in the present invention the frictional wear is distributed over the entire internal lateral surface of the spout, thus contributing to increased life of the distribution spout.

In accordance with the present invention, the lateral wall of the distribution spout may be cylindrical or, preferably, frustoconical. In the frustoconical configuration, the charging material is delivered to the spout through the end of larger cross-section and is discharged from the spout through the end of smaller cross-section. With the frustoconical spout, the acute angle formed between the axis of the spout and the axis of the blast furnace is always smaller than the angle between the falling charge (from the discharge end of the spout) and the axis of the blast furnace; whereas these angles are equal when a cylindrical spout is employed. The frustoconical spout therefore requires a smaller total tilting angle, i.e. the acute angle between the axis of the spout and the axis of the blast furnace, than that required by a cylindrical spout for any given angle of the falling charge.

In accordance with one version of the present invention, the control and driving device for the spout comprises three hydraulic jacks positioned outside the furnace and at the apices of a virtually equilateral triangle about the central supply chute which supplies the spout. The hydraulic jacks are connected to fastenings on the distribution spout also positioned at the apices of a virtual equilateral triangle.

In a second version of the present invention, the control and driving device for the distribution spout comprises a tilted bearing positioned about the intake chute, the bearing consisting of a rotatable outer ring and a non-rotatable inner ring. A driving mechanism rotates the outer ring around the intake chute and may also cause the bearing to pivot about an axis perpendicular to the axis of the intake chute. The inner ring of the bearing is connected to fastenings on the intake chute, whereby the chute is caused to move in desired patterns.

BRIEF DESCRIPTION OF THE DRAWINGS

The present invention may be better understood and its numerous objects and advantages will become apparent to those skilled in the art by reference to the accompanying drawings, wherein like reference numerals refer to like elements in the several figures, and in which:

FIG. 1*a* is a partial view taken along line A—A of FIG. 1;

FIG. 1*b* is a schematic diagram of a first control system for the embodiment shown in FIG. 1;

DESCRIPTION OF THE PREFERRED EMBODIMENTS

Figure 1:
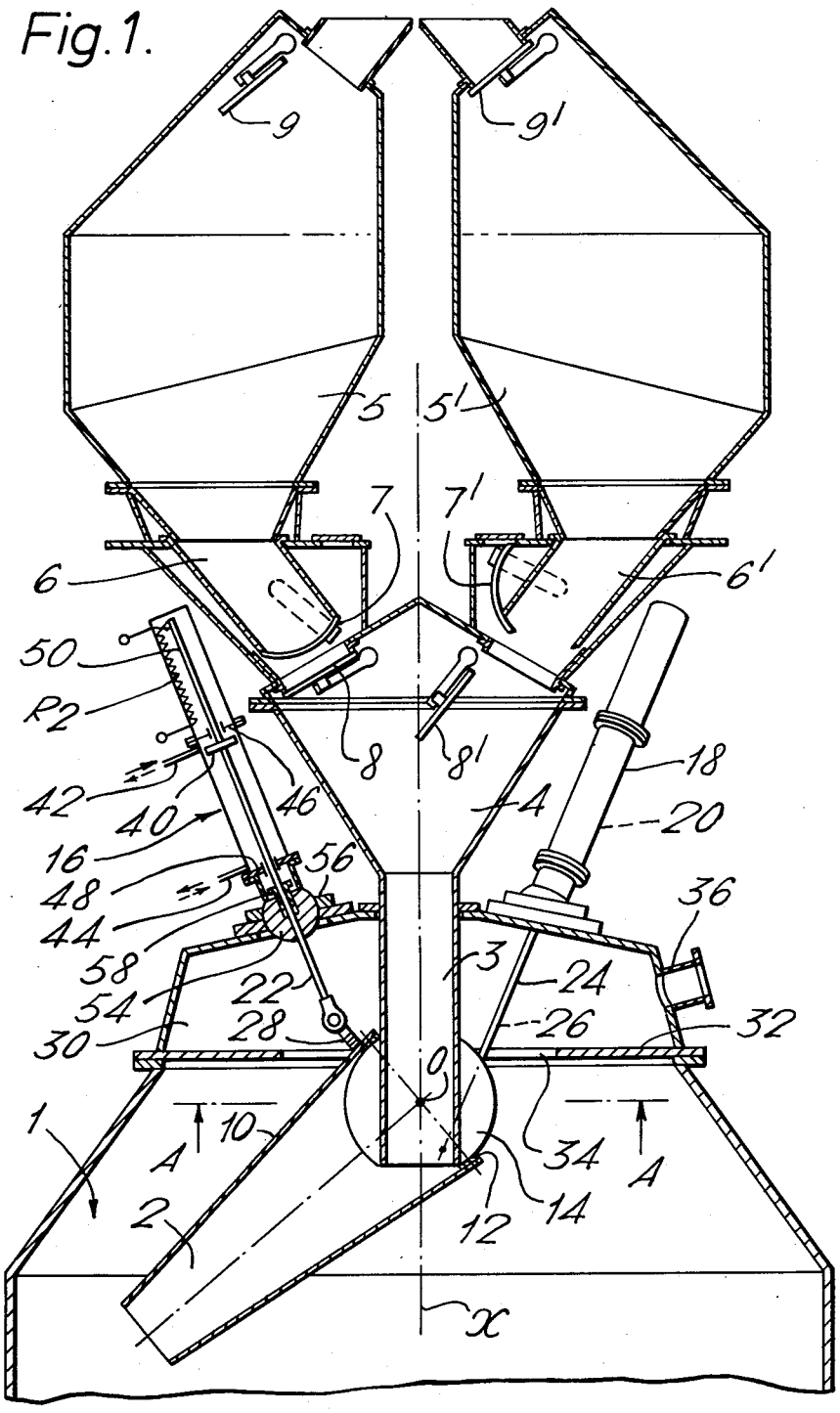
FIG. 1 is an elevation view, partly in section, of a first embodiment of the present invention.

Referring now to FIG. 1, a general view is shown of the throat of a blast furnace equipped with a charging installation and a distribution device in accordance with a first embodiment of the present invention. At the cener of the head of the blast furnace, generally indicated at 1, there is a movable distribution spout 2. The central axis of the blast furnace is indicated at *x*, and distribution spout 2 is angularly adjustable in relation to central axis *x* of the blast furnace, that adjustment sometimes being referred to in terms of the angle between axis of spout 2 and axis *x* of the blast furnace. Spout 2 is fed with materials forming the charge of the blast furnace, such as ore, coke, pellets, etc. through a fixed central feed chute 3 which widens at the top to form an admission chamber 4 which is itself connected to two storage tanks 5 and 5' via respective flow channels 6 and 6'. Each of the storage tanks 5 and 5' alternately supplies charging material to the admission chamber 4, one tank 5 being in flow communication with chamber 4 and being shut-off to the outside while the other storage tank is shut-off from chamber 4 and connected to the outside to receive additional charging material. The appropriate quantities of charge delivered to admission chamber 4 are obtained by means of two proportioning valves 7 and 7' mounted in the flow channels 6 and 6'. Shutoff valves 8 and 8' are located downstream of the respective proportioning elements 7 and 7' in order to isolate each of the storage tanks 5 and 5' from the internal pressures of the furnace when the respective tanks are being recharged from the outside. Similarly, shut-off valves 9 and 9' positioned in the feed apertures of storage tanks 5 and 5', respectively, serve to seal the tops of the storage tanks from the external atmosphere when the tanks are alternately connected to admission chamber 4. When the material is being supplied to one of the storage tanks 5 and 5', the corresponding lower sealing valve 8 or 8' is closed; whereas when charging material is flowing out of the tank 5 or 5', the corresponding sealing valve 9 or 9' is then closed in order to avoid losses of high pressure throat gases to the external atmosphere.

Distribution spout 2 consists of a tubular element in the form of a surface of revolution; spout 2 is preferably frustoconical in shape, but it may also by cylindrical. Spout 2 is suspended at its upstream base (the larger base as compared to the downstream exit base as shown in FIG. 1) by a form of a universal joint which permits both angular and rotational movement of spout 2 with respect to intake chute 3 and axis *x*. Referring to FIG. 1*a*, guide means consisting of a series of circular segments 14 are fixed to and evenly spaced around the lower part of intake chute 3. The circular segments 14 are positioned perpendicular to chute 3 in planes passing through the central axis of chute 3, which is shown as coinciding with axis *x* of the furnace, so that the planes of segments 14 all intersect at axis *x*. Theoretically, three of the segments 14 would be sufficient for the purposes of the present invention, but a larger number, such as the eight shown in FIG. 1*a*, are preferably employed for more satisfactory operation. Segments 14 may be welded directly to chute 3; or they may, for example, be fixed to a cylindrical sleeve which is in turn detachably connected to chute 3 so that the segments can easily be removed for repair or replacement.

Segments 14, which are identical to each other, define a spherical outer surface to which the distribution spout 2 is adjustably attached. The articulation between chute 2 and segments 14 is obtained by means of a shield or bearing 12 fixed to the internal surface of the upper end of wall 10 of the spout. The internal surface of shield or bearing 12 is slightly concave, having a radius of curvature equal to the radius of the spherical surface defined by the segments 14, so that shield or bearing 12 accurately fits the periphery of the sperical assembly formed by segments 14.

Considering the structure described above, it can be seen that spout 2 is articulated or universally connected to intake chute 3 so that the axis of spout 2 may be rotated abut axis *x* and may assume any desired angular orientation with respect to axis *x* within an angle which is determined by the width of the intake chute 3 and the radius of the spherical surface formed by segments 14. It is important to note that the virtual zero point 0 at the intersection between the longitudinal axis of spout 2 and the axis of intake chute 3 is necessarily the center of the spherical articulation surface defined by segments 14. Thus, spout 2 has two degrees of freedom of motion whereby spout 2 can be adjusted to assume different directions in relation to the axis of the blast furnace and can be directed toward any desired point on the charging surface of the furnace. As will be described below, by acting on spout 2 at three different points, it is possible to direct it toward a clearly defined point on the charging surface of the furnace or to change the orientation of the axis of the spout continuously in such a way that its discharge end describes a desired curve. For example, it is possible to move spout 2 in such a way as to deposit the charging material in a pattern of concentric circles or else in a spiral pattern, those two patterns being recognized in the art as being the patterns which are most efficient and provide the best results in furnace charging.

Still referring to FIG. 1, the control system for the spout consists of three identical control elements which comprise hydraulic jacks 16, 18, and 20 and rods 22, 24 and 26 controlled, respectively, by the jacks. Each of the rods is articulated to a connecting or fastening element 28 at the upstream end of spout 2 to accommodate angular as well as transverse movement between the rods and spout 2. Only one of the fastenings 28 is shown in FIG. 1, but it will be understood that the three fastenings are spaced 120° apart about spout 2 in a plane perpendicular to the axis of spout 2. Also, the control elements consisting of the jacks and rods are situated 120° apart in a plane perpendicular to the axis *x* of the furnace, so that it will be understood that jack 20 and rod 26 are not shown in FIG. 1 since they are directly in line with jack 18 and rod 24.

A chamber 30 is defined in the upper part of the head of the furnace by a partition wall 32 at the level where spout 2 is flexibly connected to intake chute 3. Wall 32 has apertures or radial slits 34 to permit the passage of the control rods 22, 24 and 26. The presence of chamber 30 makes it possible to provide cooling gases to parts of the mechanism so that they need not be exposed to the adverse conditions under which the furnace operates. For example, it has been found to be particularly advantageous to introduce a cooling and cleaning gas such as nitrogen or furnace throat gas, purified and cooled, into chamber 30 via a pipe 36. This gas is introduced at a pressure above that in the throat of the blast furnace to create a flow to the interior of the furnace, whereby the influence of the furnace temperature on the control elements of the invention is reduced. In addition, the cooling gas serves to cool and clean the contact surface between shield or bearing 12 and segments 14. If desired, additional cooling of the contact surface between bearing 12 and segments 14 could be provided by a piping system to deliver cooling gas through the walls of chute 3 and into the interior of segments 14.

Referring again to FIG. 1, the control elements for spout 2 which are shown schematically will now be described. Since, as pointed out above, there are three identical control elements (each control element including one of the jacks 16, 18 or 20, respectively) only the control element which includes jack 16 will be described, and it will be understood that the construction and operation of the other two control elements are identical to the control element described. Hydraulic jack 16 has a hydraulic piston 40 fixed to rod 22. Lines 40 and 42 connected to the interior of jack 16 each constitute inlets and outlets, in alternation, for supplying a hydraulic fluid to one side of piston 40 and removing hydraulic fluid from the other side of piston 40 to move piston 40 in one direction and the other altenately. Packings or other seals 46 and 48 seal the chamber in jack 16 in which piston 40 reciprocates. Extending from the side of piston 40 opposite to rod 22 and fixed for movement with piston 40 is a slide 50 of a rheostat $R_2$ which forms part of a regulating circuit to be described with reference to FIG. 1*b*.

Jack 16 is universally articulated in the upper wall of the furnace or of chamber 30 so that it can follow the change of orientation resulting from the displacement of the lower end of rod 22 along segments 14. This articulation is obtained through a swivel or ball joint 54 housed in a spherical cup in support element 56 fixed to the upper wall of chamber 30. Swivel element 54 has a central bore in which rod 22 slides, and a stuffing box or other seal 58 seals against leakage past rod 22. Because swivel joint 54 is mounted in the exterior wall of chamber 30, and because of the presence of a cooling and cleaning gas in chamber 30, swivel joint 54 is not exposed to the high temperatures of the blast furnace or to the abrasion caused by hot dust present in furnace throat gases. The cooling gas injected into chamber 30 may also contain, in suspenson, a lubricating liquid to provide continuous lubrication of all of the joints in or communicating with chamber 30.

Referring jointly now to FIGS. 1 and 1*b*, the interaction between the three control elements of spout 2 will now be described, reference once again being made to one jack, 16, of the three identical control elements. A control and regulating circuit, generally indicated at 60, controls the delivery of hydraulic fluid to the inlet 42 and 44 to achieve a predetermined desired motion of rod 22. Each of the jacks 16, 18 and 20 is governed by a control and regulating circuit identical to circuit 60.

Control circuit 60 has a motor 61 of variable angular speed driving an output shaft 62. Cams 64, 66 and 68 are fixed to output shaft 62, each of the cams forming part of a separate electrical circuit controlling a four-way valve to serve its associated jack. Control 60 has an electrical system which comprises a direct current source S, two rheostats $R_1$ and $R_2$ connected in series with current source S, a variable resistor $R_A$ in series with rheostat $R_2$, and a control element 73 which consists of a coil 72 and a plunger core 74. The slide 70 of rheostat $R_1$ is controlled by cam 64, while the slide 50 of rheostat $R_2$ is connected to the piston 40 of jack 16. The core 74 of coil 72 is connected to a pivoting rod 77 which controls a four-way valve 78.

Two operating modes of circuit 60 will be discussed; the first being the operating mode in which hydraulic fluid is delivered through inlet 42 to drive piston 40 downwardly; and the second being the mode in which hydraulic fluid is delivered through inlet 44 to drive piston 40 upwardly. Assuming that motor 61 rotates in the direction in which cam 64 tends to move slide 70 to reduce the resistance of resistor $R_1$, the current I in the electrical circuit will increase, and the plunger core 74 of coil 72 will be drawn increasingly inside the coil. The movement of core 74 is resisted, i.e. opposed, but not prevented, by a spring 76 which is also connected to rod 77. When the current I exceeds a certain threshold value, plunger 74 will be sufficiently drawn into coil 72 to pivot rod 77 clockwise to activate valve 78 whereby hydraulic fluid under pressure is delivered from a source 79 to inlet 42 and flows from inlet 44 to the source to drive piston 40 downward.

The downward motion of piston 40 causes slide 50 of rheostat $R_2$ to move in the direction corresponding to an increase in the resistance of rheostat $R_2$, thus tending to reduce the current I in the electrical circuit. The action of the two rheostats $R_1$ and $R_2$ in circuit 60 is thus opposed; an increase in the current I caused by the rotation of cam 64 in a direction to reduce the resistance of rheostat $R_1$ is opposed and counterbalanced at a point in time by the decrease in the resistance of $R_2$ resulting from the movement of slide 50 when piston 40 is driven downward. The current I thus fluctuates and stabilizes about a value $I_1$ which is above the threshold value required to activate coil 72 to keep plunger 74 drawn inside the coil. Piston 40 thus continues to descend.

When slide 70 arrives at the end of its travel in the direction to reduce the resistance of $R_1$ in the circuit, slide 70 continues to follow cam 64 and thus starts to move in the reverse direction whereby the resistance of $R_1$ is increased. At the time when the direction of movement of slider 70 reverses, slide 50 of rheostat $R_2$ is always displaced in the direction corresponding to an increase in the resistance of $R_2$, and thus the level of the current I rapidly decreases under the cumulative effect of the resistance of $R_2$ and the increasing resistance of $R_1$. The circuit current quickly falls below the threshold value which is required to draw and retain core 74 in coil 72, and thus spring 66 pivots rod 77 counterclockwise to cycle valve 79 whereby the hydraulic fluid is delivered to inlet 44 and flows from inlet 42. The delivery of hydraulic fluid to inlet 44 drives piston 40 upwardly, thus displacing slide 50 in a direction to reduce the resistance of $R_2$. The reduction of current I resulting from the reversal in the direction of movement of slide 70 is now followed by an increase in the current I resulting from the displacement of slide 50 of $R_2$. The circuit current I now again becomes stabilized around a value $I_2$, $I_2$ being lower than the previous threshold value $I_1$ and therefore not sufficient to attract the core 74 to reverse the flow of fluid in inlets 42 and 44. However, when cam 64 again drives slide 70 in the direction to reduce the resistance of $R_1$, the higher threshold current $I_1$ will again be established in the manner previously described. Thus, it can be seen that the control circuit operates to cause piston 40, and hence rod 22 to reciprocate in a programmed manner.

As pointed out above, each of the cams 66 and 68, although on a common shaft and driven by a single motor 61, is also associated with a separate control and regulating circuit identical to circuit 60, and each is associated with a different one of the jacks 18 and 20. The cams 64, 66 and 68 are positioned 120° apart on shaft 62, corresponding to the relationship between the jacks 16, 18 and 20 around central axis *x* of the blast furnace; and the cams thus synchronously control the reciprocal motion of rods 22, 24 and 26. Bearing in mind that the three points of connection 28 of the rods 22, 24 and 26 to spout 2 define a plane, the synchronized movement of rods 22, 24 and 26 results in a movement of that plane by longitudinal displacement of the points defining the plane and results in a displacement of the discharge end of spout 2. If the amplitude and displacement speeds of rods 22, 24 and 26 are equal, the discharge end of spout 2 will describe a circle about the axis *x* of the furnace.

Circuit 60 is adjustable by means of the variable resistor $R_A$. Since $R_A$ combines with $R_1$ and $R_2$ to define the resistance in the circuit, $R_A$ can function to adjust the threshold value at which the regulating valve 78 is switched as the circuit current I changes from $I_1$ to $I_2$ or from $I_2$ to $I_1$.

The circle described by the end of spout 2 can be modified by an equal change in the distance traveled by each of the three rods 22, 24 and 26. For example, to increase the radius of the circle, it is necessary to increase the travel of the rods 22, 24 and 26, i.e. to increase the amplitude of the displacement of the pistons of jacks 16, 18 and 20; and, similarly, a decrease in the radius of the circle requires a decrease in the travel of the rods.

An increase in the amplitude of the movement of piston 40 can be accomplished merely by reducing the rotational speed of cam 64. A reduction in the rotational speed of cam 64 reduces the rate of movement of slide 70, thus increasing the operating time of each cycle by increasing the time during which the hydraulic fluid is introduced through each of the inlets 42 and 44 in each cycle. For a given constant rate of hydraulic flow in the system, the increased time of flow through each inlet produces an increase in the amplitude of the movement of rod 22. Thus, an adjustment (by means not shown) to reduce the speed of motor 61 results in an increase in the circle defined by the end of spout 2. Similarly, a reduction in the amplitude of the movement of piston 40, which can be achieved by increasing the rotational speed of motor 61 to increase the rotational speed of cam 64, will reduce the radius of the circle defined by the end of spout 2. Of course, similar changes will occur in the rotational speed of all of the cams, thus producing an equivalent change in the movement of each of the rods 22, 24 and 26.

A regulating valve 80 between source 79 and valve 78 also can be used to control the flow of hydraulic fluid and therefore control the speed of movement of piston 40. Valve 80 is positioned in a feed pipe common to the three control and regulating circuits corresponding to each of the jacks 16, 18 and 20, so that an increase or reduction in the flow of the hydraulic fluid causes an increase or reduction in the speed of movement of the control rods 22, 24 and 26, thus leading to an increase or reduction in the linear speed of the end of spout 2. In view of the fact that the amplitude of the movement of piston 40 is a function of the rotational speed of cam 64 and that a variation in the flow of the hydraulic fluid also leads to a change in the speed of the movement of piston 40, it will be noted that any variation in the flow of the fluid will also cause a change in the amplitude in the movement of piston 40, even if the rotational speed of cam 64 is kept constant.

By way of summary, two different circumstances of control or adjustment may be distinguished. With a constant flow of fluid through valve 80, which corresponds to a constant linear speed of the discharge end of spout 2, a variation in the rotational speed of motor 61 will lead to a change in the amplitude of the movement of rods 22, 24 and 26. This leads to a change in the angular position of spout 2 in relation to the axis of the furnace; i.e. the angle between the axis of the spout and axis *x* of the furnace is varied because the end of spout 2 describes a circle of different radius. The end of spout 2 may thus be moved at a constant linear speed through concentric circles by a series of adjustments of the rotational speed of motor 61; or the end of spout 2 may be moved over a spiral trajectory around the axis of the furnace by continuous adjustment of the rotational speed of motor 61.

In the second mode of control, the rotational speed of motor 61 is kept constant while the flow of hydraulic fluid is varied (by valve 80 or otherwise). This leads to a change in the speed and the amplitude of the movement of piston 40. An increase in the flow of the hydraulic fluid leads to an increase in the amplitude of the movement of piston 40 and in its speed of movement, i.e., the linear speed of the end of spout 2 increases to the extent to which it moves away from the axis *x* of the furnace. Conversely, a decrease in the flow of the hydraulic fluid leads to a decrease in the amplitude of the movement of piston 40 and its speed of movement. In this second control mode the end of spout 2 can also be caused to move either over a spiral trajectory or in concentric circles by continuously or intermittently varying the flow of the hydraulic fluid when the speed of rotation of motor 61 is kept constant. In this case, however, the linear speed of the end of spout 2 is proportional to the radius of the circle or spiral which it describes, i.e. its angular speed about the axis of the furnace is constant, whereas in the first control mode the linear speed of the end of spout 2 is constant while its angular speed varies.

In order to change the linear speed of the end of spout 2 by means of valve 80 without at the same time causing an angular displacement of spout 2, a speed governor 82 is connected between valve 78 and motor 61. Speed governor 82 is responsive to the flow of hydraulic fluid and serves to adjust the rotational speed of motor 61 as a function of the flow of fluid in the system to compensate the change caused in the amplitude of the movement of piston 40 by variations in the opening of valve 80. Speed governor 82 causes an increase or reduction in the rotational speed of motor 61 and of the cams 64, 66 and 68 in the event of an increase or decrease, respectively, in the flow of hydraulic fluid in the system.

Control system 60 thus enables the furnace charging operation to be controlled in any predetermined desired pattern by regulating the rotational speed of motor 61 and/or by regulating valve 80.

Figure 1C:
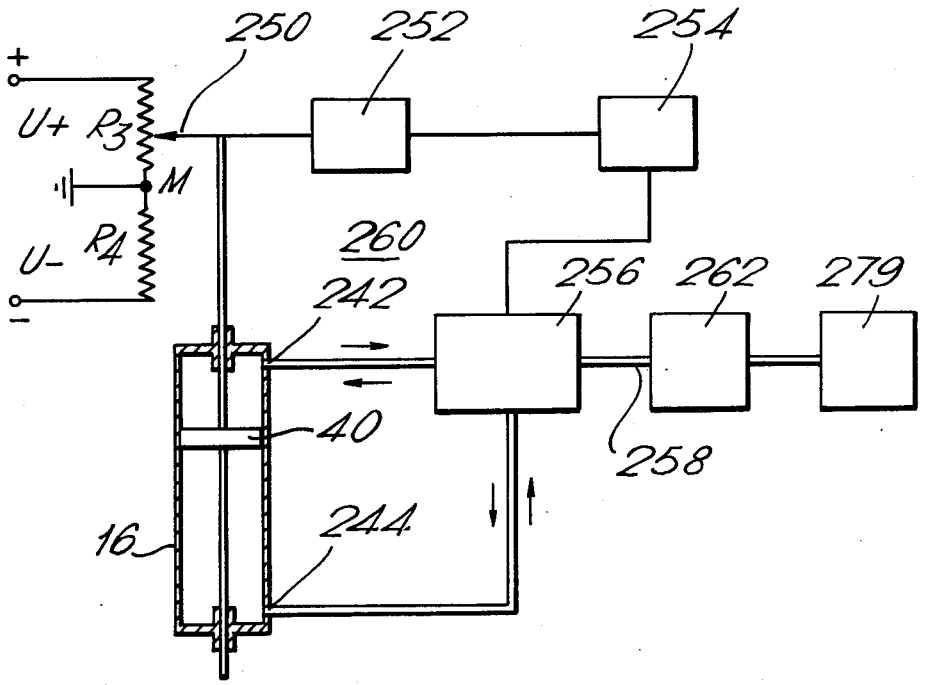
FIG. 1*c* is a schematic diagram of a second control system for the embodiment shown in FIG. 1.

Referring now to FIG. 1*c*, a second version of a control system, indicated generally at 260, for the hydraulic jacks 16, 18 and 20 is shown. Control circit 260 has a pair of equal resistors $R_3$ and $R_4$ connected in series. Resistor $R_3$ is connected to a positive voltage source indicated at U+ and resistor $R_4$ is connected to a negative voltage source indicated as U−, and the point M between resistors $R_3$ and $R_4$ is grounded. The slide 250 connected to a movable with piston 40 of hydraulic jack 16 moves across resistors $R_3$ and $R_4$ to vary the resistance in the circuit. Slide 250 is electrically connected to a voltage level detector 252, the output of which is connected to a bistable flip-flop 254 which has two levels of output which will be referred to herein as A and B. The output of flip-flop 254 is connected to and controls a four-way flow control valve 256 which serves to alternately deliver fluid to and return fluid from inlets 242 and 244 in jack 16. The hydraulic fluid is delivered to valve 256 via pipe 258 which is connected through a control valve 262 to a source 279 of pressurized hydraulic fluid. Control valve 262 functions to vary the flow of hydraulic fluid to vary the speed of movement of piston 40.

Figure 1D:
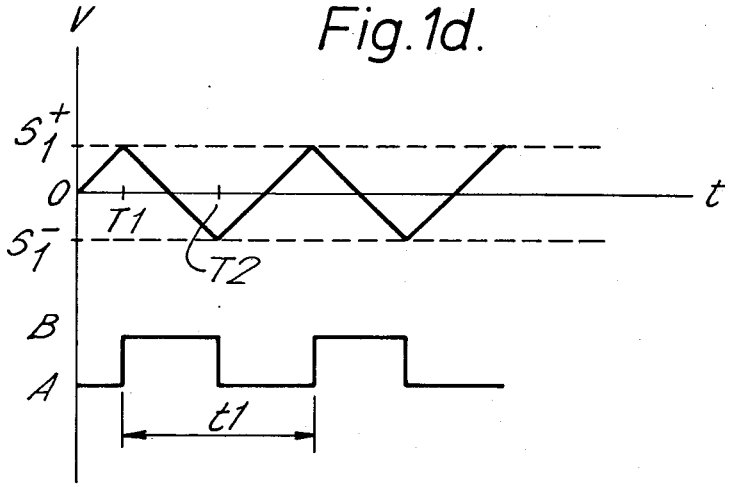
FIG. 1*d*, 1*e* and 1*f* are charts representing the operation of the control system of FIG. 1*c*.

The operation of the control circuit shown in FIG. 1*c* will be explained with reference to FIGS. 1*d*, 1*e* and 1*f*. Piston 40 begins to move as soon as hydraulic fluid is delivered to either inlet 242 or 244. Assuming that the fluid is delivered to inlet 244, piston 40 will be driven upwardly. When piston 40 is at the midpoint in the height of jack 16, slide 250, the position and travel of which is always commensurate with piston 40, is at point M corresponding to zero voltage. Further upward movement of piston 40 and slide 250 results in an increase of the voltage input to voltage detector 252. When the voltage delivered to level detector 252 reaches a set threshold value, level detector 252 sends a signal to bistable flip-flop 254. In a configuration represented by FIG. 1*d*, level detector 252 is set to a threshold level $S_1$; and when the input voltage to detector 252 reaches the threshold $S+_1$, at time $T_1$, level detector 252 triggers bistable flip-flop 254 from the A to the B state. This change of state of flip-flop 254 activates four-way valve 256 to reverse the direction of circulation of the hydraulic fluid whereby the hydraulic fluid is delivered to inlet 242 to drive piston 40 downward. At time $T_1$, then piston 40 begins to move downward, thus also resulting in a linear decrease of the voltage at the input of level detector 252, which voltage falls to zero when slide 250 is at the M point and becomes negative when slide 250 moves onto resistor $R_4$. When the position of slide 250 on resistor $R_4$ is such that the negative voltage input to level 252 reaches the threshold $S-_1$ at time $T_2$, flip-flop 254 is again triggered to its A state, thus again causing a shift in four-way valve 256 to change the direction of flow of hydraulic fluid to be delivered to inlet 244. Piston 40 then again begins to move upwardly to begin another cycle of oscillation or reciprocation.

Each of the jacks 16, 18 and 20 is, of course, provided with a control circuit 260 to provide synchronized movement of spout 2 to define concentric circles or a spiral trajectory. The speed of movement of spout 2 and the angle of inclination in relation to axis *x* of the furnace can easily be varied, respectively, by regulating the flow of the hydraulic fluid by adjustable valve 262 and by changing the selectable threshold of level detector 252. These two parameters, i.e. hydraulic fluid flow and threshold level can be regulated independently of each other.

Figure 1E:
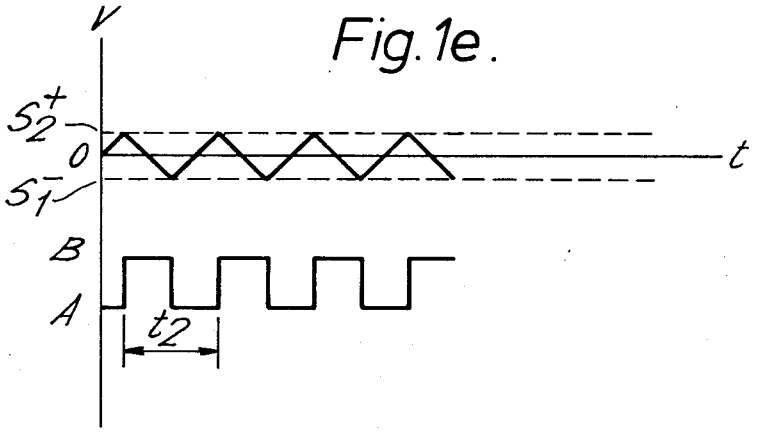
Figure 1F:
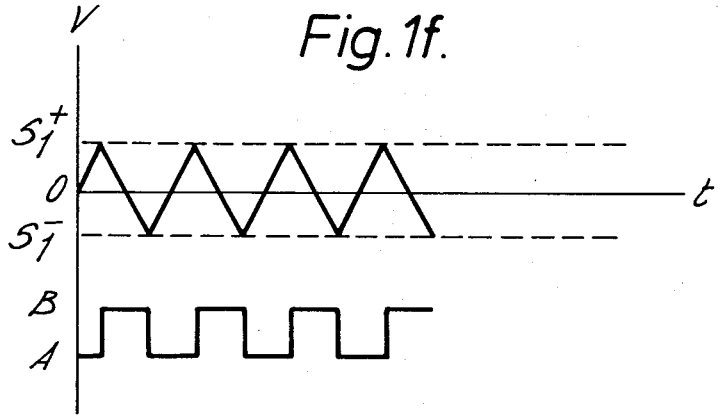

If the threshold level of detector 252 is reduced to a value below $S_1$, such as to a value $S_2$ as shown in FIG. 1*e*, the amplitude of the movement of piston 40 is thereby reduced, i.e. piston 40 travels a shorter stroke in both the upward and downward directions. With a similar adjustment of the stroke of the pistons of each of the three jacks, the radius of the circle or of the turn of the spiral described by the end of spout 2 becomes smaller. If the linear speed of the displacement of spout 2 does not change, the frequency of revolution of spout 2 about axis $x$ of the furnace will increase, as may be seen in FIG. 1*e* by a comparison of the triggering period $T_2$ of bistable flip-flop 254 with the period $T_1$ in FIG. 1*d*.

If the flow of the hydraulic fluid is changed by adjustment of valve 262, a change in the speed of movement of slide 250 will be effected, thus resulting in a change in the rate at which the voltage applied to detector 252 varies. Assuming the existence of the conditions depicted in FIG. 1*d*, an increase in the output of valve 262 will result in an operating condition such as depicted in FIG. 1*f*. The amplitude of the displacement of piston 40, i.e. the stroke of piston 40, remains the same, but the speed of movement of piston 40 is greater in the condition depicted in FIG. 1*f*. The end of spout 2 thus describes the same circles in FIGS. 1*d* and 1*f*, but at a higher rate of speed in the configuration depicted in FIG. 1*f*.

Control circuits other than those known in FIGS. 1*b* and 1*c* can be constructed to produce the rotation and angular movement of the discharge end of spout 2. All such circuits, however, must have the characteristics that the speed and amplitude of the movement of the pistons can be modified synchronously in accordance with a predetermined program in order to control the movement of the spout and thus control the delivery of the charge to the furnace.

Figure 2:
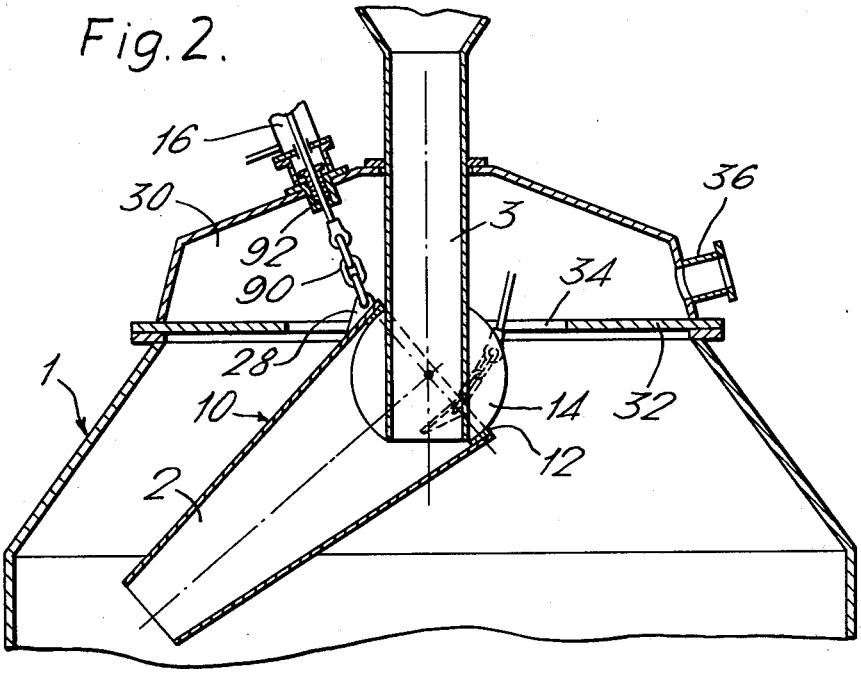
FIG. 2 is an elevation view, partly in section, of a second embodiment of the present invention.

Referring now to FIG. 2, a variation of the system of FIG. 1 is shown. The essential difference between the embodiment shown in FIG. 2 and that shown in FIG. 1 is found in the connection between the jacks 16, 18 and 20 and spout 2. In the FIG. 1 embodiment the connection from the hydraulic jacks to spout 2 is effected by means of the rods 22, 24 and 26; in the FIG. 2 configuration chains, one of which is chain 90, corresponding to rod 22, are employed to achieve the displacement of spout 2. The regulating circuit and the other two hydraulic jacks have not been shown in FIG. 2, but it will be understood that their arrangement and operation are identical to the corresponding items in the FIG. 1 configuration.

The chains in the FIG. 2 embodiment are connected to the end of the piston rod extending out of jack 16. In other words, chain 90 may be viewed as a replacement for all or part of rod 22 extending out of the jack. In the FIG. 1 embodiment the jacks must be universally mounted as by swivels 54 as shown, to accommodate the angular displacement of the rods 22 which accompanies movement of spout 2; however, in the FIG. 2 embodiment the articulation of the links of the chain accommodates the movement of spout 2, and thus the jacks may be rigidly connected to the furnace as by rigid support 92. Chain 90 permits all possible orientations of spout 2 in relation to jack 16. It will be apparent that in the FIG. 2 configuration displacement of spout 2 can only be effected by pulling on the chains, whereas in the FIG. 1 embodiment movement can be effected by exerting a pull on one or two of the rods and a push on the other rods or rod. Thus, in the FIG. 2 configuration the spherical joint formed by the segments 14, and consequently the point of intersection between the axis of apout 2 and the axis of intake chute 3 must be fixed in relation to chute 3; whereas in the FIG. 1 embodiment a slight sliding movement between the segments 14 and intake chute 3 could be accommodated. If the point of intersection were not fixed in the FIG. 2 configuration, spout 2 would be able to tilt in the direction of axis $x$ of the furnace under the effect of its own weight since the center of gravity of spout 2 is below its junction with segments 14. This tilting would take place about an axis passing through two of the fastenings 28 and would cause the third fastening 28 to rise along the spherical surface of segments 14 with a slackening of the chain corresponding to that third fastening. This movement would not be possible with the FIG. 1 embodiment since fastenings 28 cannot undergo any displacement in relation to the control rod, and the control rods are themselves rigidly held by the hydraulic forces.

Figure 3:
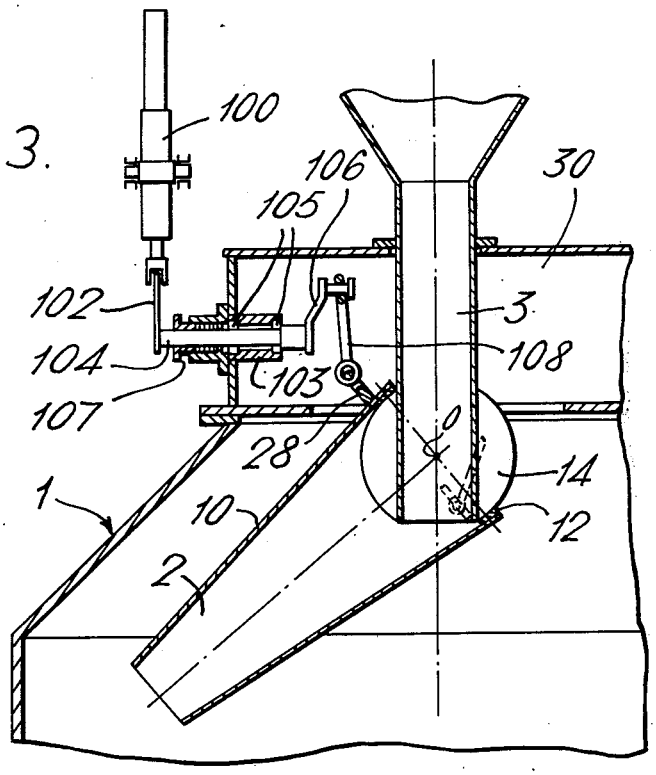
FIG. 3 is an elevation view, partly in section, of a third embodiment of the present invention.

Referring now to FIG. 3, another embodiment of the present invention is shown. In the embodiment of FIG. 3 a hydraulic jack 100 located outside of the blast furnace is connected through a connecting rod 102 to rotate a rotary shaft 104. Shaft 104 passes through the wall of furnace 1 and is integrally connected with a crank 106 in chamber 30. Rotary shaft 104 is mounted in a support 103 by means of ball bearings 105. Any movement of crank 106 is transmitted to an arm 108 which, through a joint connection to fastening 28 acts on the fastening 28 of the distribution spout 2. Although only one jack 100 is shown in FIG. 3, it will be understood that there are three such jacks and the associated rotary shaft and crank structure distributed 120° apart around the furnace; each connected to a fastening 28 spaced 120° apart around spout 2. The operation of the piston of each of the jacks 100 causes rotation of its associated shaft 104 to rotate about a predetermined angle to act through crank 106 and arm 108 to produce a displacement of the distribution spout 2. Each of the hydraulic jacks is controlled by a regulating and control circuit analogous to those shown in FIGS. 1*b* and 1*c*, and it will be understood that the combined synchronized action of these control circuits provide the same capabilities for movement of the spout as previously described with respect to FIGS. 1 and 2.

While the embodiments illustrated in FIGS. 1 and 2 involve either joints and/or the problem of sealing the longitudinally moving rod to isolate the interior chamber 30 from the atmosphere, the configuration shown in FIG. 3 offers the added advantage that it is only necessary to seal rotary shaft 4 which can easily be achieved by means, for example, of a stuffing box 107.

Figure 4:
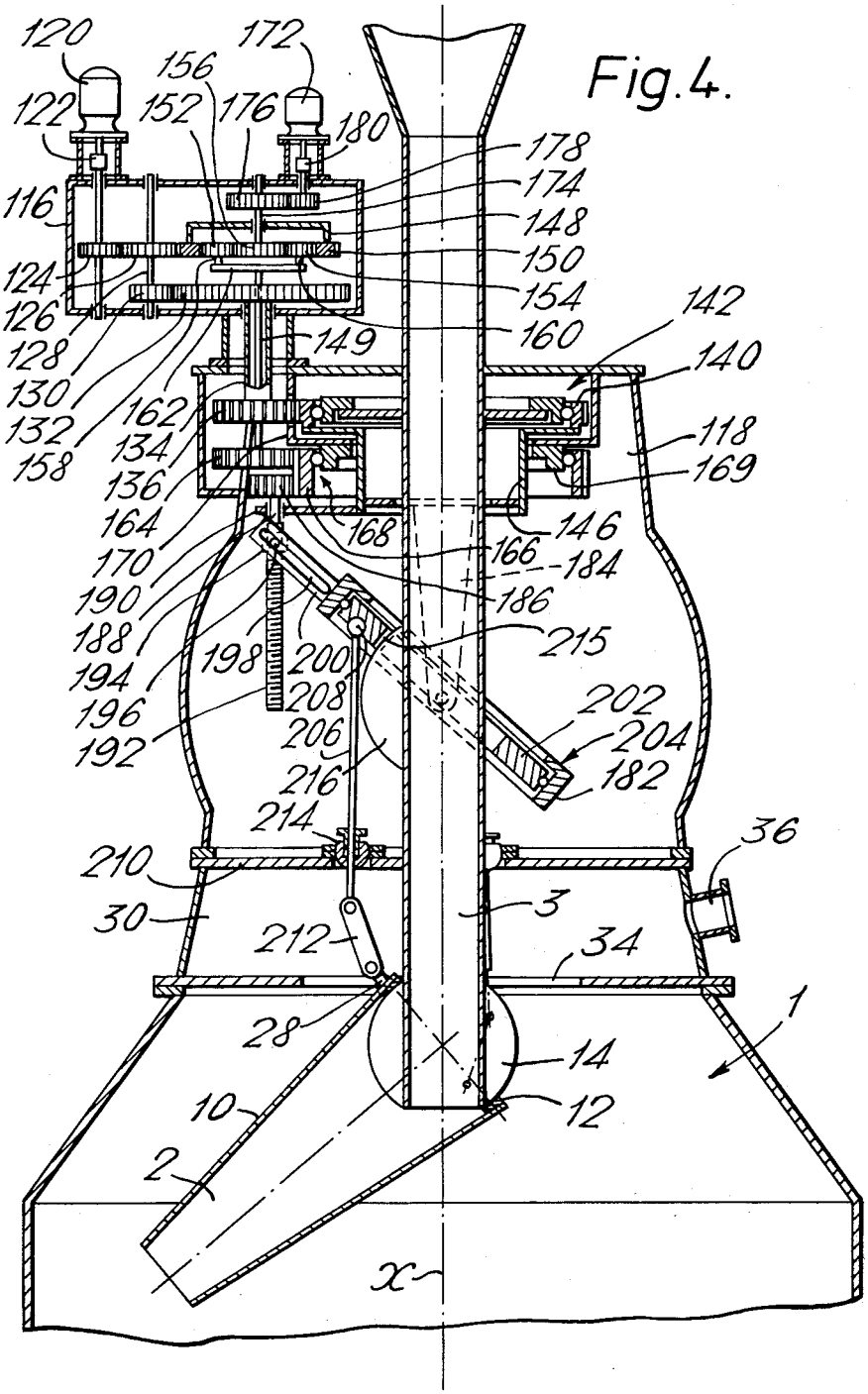
FIG. 4 is an elevation view, partly in section, of a fourth embodiment of the present invention.

Referring now to FIG. 4, another embodiment of the present invention is shown. In this FIG. 4 embodiment some of the control elements for spout 2 are installed in a control case 118 located above and insulated from chamber 30. A second case 116, which may be located outside of the furnace, contains the gears required for the control in this configuration. In the FIG. 4 embodiment the main driving motor 120 is connected via a brake and clutch system 122 and a gear train 124, 126 to a main driving shaft 128. Shaft 128 is connected through gearing 130 and 132 to drive a hollow shaft 134 which is integral with a pinion 136 which, in turn, engages with a toothed rim or ring gear 140. Rim or ring gear 140 forms the outer ring of a bearing 142 located around and coaxial with intake chute 3. A cylindrical cage 146 is also integral with toothed ring 140 and is coaxial with chute 3. Toothed rim or ring gear 140 and cage 146 are free to rotate in relation to intake chute 3.

The gear 126 of main driving shaft 128 drives an auxiliary shaft 149 via a planetary gear train 148, auxiliary shaft 149 being employed to modify the angle of inclination of distribution spout 2 with respect to intake chute 3 as will be described below. Planetary gear train 148 consists of a peripheral toothed rim or ring gear 150 which has both external and internal teeth. The external teeth of ring gear 150 engage the gear wheel 126 of the main shaft, and the planetary gear train also includes two satellite gears 152 and 154 and a central pinion 156. The two satellite gears 152 and 154 are positioned diametrically opposite in respect to the central pinion 156 and engage the internal teeth of ring gear 150 as well as the central pinion. The two satellite gears 152 and 154 of the planetary gear train 148 drive a planetary plate 162 by their respective shafts 158 and 160. This planetary plate 162 is integral with auxiliary shaft 149. Shaft 149 is coaxial with hollow shaft 134 and passes through gears 132 and 136 and is connected to a gear 164 at the end opposite to planetary plate 162. Gear 164 drives a toothed rim or ring gear 166 forming the external ring of a bearing 168. The internal ring 169 of bearing 168 is fixed, via a sheet metal suspension, to the upper wall of case 118.

The central pinion 156 of planetary gear train 148 is connected to a motor 172 which is effective to control the tilting angle of spout 2 via a driving shaft 174, a gear train 176, 178 and a brake and clutch device 180.

A pivot bearing 204, comprising an internal ring 202 and an external ring 182, is suspended by ring 182 at two diametrically opposite points, from two brackets 184 and 184', of which only the bracket 184 is shown in FIG. 4, by broken lines. These two brackets are secured at their upper ends to the lower part of the rotating cage 146. The outer ring 182 of the bearing 204 is positioned around the central intake chute 3 and may rotate freely with cage 146 in relation to the chute 3 and also may occupy different angles of inclination in relation to the axis of the intake chute 3, in view of its two-point suspension.

The toothed rim 166 drives a pinion 186 integral with a shaft 188 passing through a bearing in a base 190 of the rotating cage 146. The shaft 188 is provided, at the end opposite to that bearing the pinion 186 and below the base 190, with a screw threading 192 which actuates a traverse 194. Two journals 196 and 196' (196' not being shown in FIG. 4) are provided at diametrically opposite points on the traverse 194 and slide in oblong holes 198 and 198' (198' not being shown in the diagram) on a double follower arm 200 integral with the outer ring 182 of the bearing 204. A rotation of the pinion 186 about its axis causes the traverse 194 to move along the screw threading 192 and, as a result of the sliding movement of the journals 196 and 196' in the oblong holes 198 and 198', causes a change in the angle of inclination of the bearing 204.

The internal ring 202 of the bearing 204 is mounted on and free to move longitudinally with respect to a guide 216, guide 216 being in the form of a circular segment and affixed to the wall of the intake chute 3. The curvature of this guide is such that its center is situated on the axis passing through the two points by which the outer ring 182 is suspended from the brackets 184, 184'. As mentioned above, the outer ring 182 of the bearing 204 may rotate about the intake chute 3 and at the same time pivot about its suspension axis, i.e. an axis perpendicular to the center of the plane of the outer ring may describe a conical surface of variable angle about the intake chute 3.

The inner surface of the inner ring 202 of the bearing 204 is provided with a groove 215 into which the outer edge of the guide 216 penetrates and which prevents the inner ring 202 from performing the slightest rotation about the intake chute 3. The combined action of this groove 215 and of the guide 216 thus neutralizes the driving torque communicated during the rotation of the outer ring 182 of the bearing 204 to the inner ring 202. If this inner ring is unable to rotate about the intake chute it must, on the contrary, follow the angle of inclination of the outer ring 182 when the latter is tilted about its suspension as a result of a displacement of the traverse 194. When the bearing 204 pivots in this way about its suspension axis, which always remains perpendicular to the axis of the intake chute 3, the groove 215 slides along the outer edge of the guide 216.

FIG. 4 shows a rod 206 pivotally connected by one end to the inside of the inner ring 202 of the bearing 204, by means of a universal swivel 208. This rod 206 passes through the partition wall 210 between the case 118 and the chamber 30 and is pivotally connected, at the end opposite to the swivel 208, to a connecting rod 212 which is itself pivotally connected to the distribution spout 2. Two other rods, not shown in FIG. 4, connect the bearing 204 to the spout 2 in exactly the same manner. The three rods are offset in relation to one another, around the intake chute 3, by an angle of 120°. Each of the rods is pivotally connected to the partition wall 210 by means of the swivel 214 which they pass through and each rod is slideable with respect to its swivel.

In order to render FIG. 4 clearer, not all its parts have been drawn to the same scale. The height and particularly the length of the intake chute have been exaggerated in relation to the diameter of the blast furnace.

During the operation of the control mechanism of the spout 2 in accordance with FIG. 4 the driving motor 120 causes the toothed rim 140 and the cage 146 to rotate. The driving motor 120 also rotates the toothed rim 166, via the planet gear train 148 and the shaft 149. By the selection of suitable transmission ratios for the different intermediate gear trains the two toothed rims 140 and 166 can be caused to rotate at the same angular speed in relation to the axis of the intake chute 3. When rim 140 and 166 rotate at the same angular speed, there is no relative displacement between the rim 166 and the base 190 of the rotating cage 146, and the pinion 186, which engages the rim 166 and of which the shaft passes through a bearing in the base 190, is driven around the intake chute 3 but does not rotate about its axis. It follows that the outer ring 182 of the bearing 204, which is suspended at three points, one of which consists of the journals 196 and 196', rotates about the axis of the intake chute 3 at a constant angle of inclination in relation to the said chute. If the outer ring 182 is situated obliquely in respect to the axis of the chute 3, e.g. as shown in FIG. 4, the end of the spout 2 describes a circle about the axis $x$ of the furnace 1. The fact is that as the outer ring 182 of the bearing 204 does not rotate about its own axis, but about the axis of the chute 3, in respect of which it is inclined, the axis of the ring 182 generates, during this rotation, a conical surface about the chute 3, and each point on the outer ring 182 moves in a circular trajectory in a plane perpendicular to the axis of the intake chute 3. As the inner ring 202 of the bearing 204 is held by the rods 206 and the guide 216 and therefore cannot rotate about the chute 3, and as its angle of inclination is integral with that of the outer ring 182, it will continually tilt about its center, in such a way that any point of the inner ring 202, but particularly the centers of the swivels 208, will perform a reciprocating movement in the direction of the spout 2, moving along an arc. The three rods 206 therefore slide longitudinally and synchronously in their swivel joint 214 and impart to the spout 2 a movement analagous to that described in connection with the embodiments shown in FIGS. 1–3. The end of the spout 2 therefore moves in accordance with a circular trajectory about the axis *x* of the furnace 1, simply as a result of the synchronous movement of its three suspension points. The speed of this movement is obviously a function of the driving speed of the motor 120.

With the aid of the motor 172 it is possible to drive the toothed rim 166, via the planet gear train 148, at an angular speed which is higher or lower than the speed of the cage 146 and of its base 190. The difference in rotation speed between the cage 146 and the toothed rim 166 leads to a rotation of the pinion 186 about its axis and consequently to a vertical displacement of the traverse 194. The direction of movement of the traverse 194 obviously depends on the direction of rotation of the pinion 186, which rotates in one direction or the other, according to whether the rotation speed of the rim 166 is above or below that of the cage 146. The motor 172 is consequently reversible in its polarity, so that it can rotate in either direction.

It is also possible, by the choice of different transmission ratios between the gear trains, to ensure that the synchronism between the rotation speed of the rotating cage 146 and that of the toothed rim 166 is only provided for one particular rotation speed of the motors 172 and for one particular rotation speed of the driving motor 120. In other words, the synchronism between the rotating cage 146 and the toothed rim 166 will in this case only apply to a certain preselected ratio between the rotation speed of the driving motor 120 and that of the motor 172. An increase or reduction in this speed ratio will cause the toothed rim 166 to rotate at a higher or at a lower speed than the cage 146. This difference in rotation speed depends on the momentary ratio between the speeds of the two motors 120 and 172 and is proportional to the said ratio. In this version of the invention it is no longer necessary for the motor 172 to be of the reversible polarity type, since the toothed rim 166 can be caused to rotate at a lower speed than the cage 146 by reducing the rotation speed of the motor 172.

By driving the rim 166 at a different speed from the cage 146, therefore, a change in the angle of inclination of the bearing 204 is obtained, by the rotation of the pinion 186 and the displacement of the traverse 194. This change in the angle of inclination of the bearing 204 results in a modification to the amplitude of the movement of the control rods 206 and thus in a change in the angular position off the distribution spout 2 in respect of the axis of the intake chute 3 and of the blast furnace.

By way of summary, if the toothed rim 166 and the cage 146 rotate at equal angular speeds about the intake chute 3, the end of the distribution spout 2 will describe a circle about the axis *x* of the blast furnace 1. If the toothed rim 166 and the cage 146 rotate at different angular speeds, the angle of inclination of the spout 2 in respect of the axis of the intake chute 3 and of the blast furnace 1 will be modified, and the radius of the circle described by the end of the spout 2 will consequently increase or decrease according to the direction in which the angle of inclination has been thus modified. According to whether the angular rotational speeds of the rim 166 and the cage 146 differ intermittently or continuously, the distribution spout discharges material in concentric circles or in spiral trajectories.

Whether the distribution spout 2 is deiven by the aid of hydraulic jack, as in the embodiment shown in FIGS. 1, 2 and 3, or by the aid of motors, as in the embodiment shown in FIG. 4, the present invention enables the spout 2 to be directed towards any point on the charging surface or the entire charging surface to be swept the spout in closed or open curved trajectories. In particular, the present invention enables charging material to be deposited in concentric circles or in a spiral trajectory and in accordance with the process which consists of increasing the distance between the concentric circles or the turns of the spiral from the wall of the blast furnace towards the central axis of the latter by a geometrical progression. This process is at present considered to be that which gives the best results as regards the evenness of the height of the deposited material when the distribution operation is commenced by depositing a layer on the periphery of the furnace.

In view of the fact that the method of control provided by the present invention for the distribution spout enables every imginable distribution operation to be carried out, particularly a distribution of the charge in concentric circles or in a spiral trajectory, without recourse to a mechanism serving to rotate the suspension system of the spout about the axis of the furnace, the extent of the technical progress provided by the charging device for shaft furnaces according to the present invention should be apparent to those skilled in the art.

In view of the present invention, it is now possible for practically all the elements driving the spout to be isolated from the head of the blast furnace and positioned in one or more separate cases. The only element which necesarily have to be partly mounted in the head for the displacement of the spout. But all major elements, particularly the supports, bearings and gears, are henceforth protected from the harmful and corrosive action of the furnace throat gases, which means that they suffer considerably less wear than in the prior art and that the maintenance costs are greatly reduced.

A further advantage offered by the fact that the control elements are situated outside the furnace enclosure is the easy accessibility of these elements and the greater safety for maintenance personnel when a defective part has to be removed and replaced. Since a complete stoppage of a blast furnace is out of the question, for economic reasons, the replacement of a component which has suffered from the action of the blast furnace gases is usually a dangerous operation, owing to the presence of the gases, placing the personnel at risk, despite any safety measures taken. When the driving devices are situated outside the zone of influence of the gases as in this invention, there is not only easy access to these devices but also, and above all, a considerable reduction of the risk of accident.

While preferred embodiments have been shown and described, it will be understood that various modifications and substitutions may be made thereto without departing from the spirit and scope of the invention. Accordingly, the present invention has been described by way of illustration and not limitation.

What is claimed is:

1. Apparatus for charging a shaft furnace including:

tubular distribution means mounted in said furnace for distributing charge material to said furnace, said distribution means having an axis and oppositely disposed inlet and discharge ends;

guide means in said furnace for supporting said distribution means adjacent its inlet end for movement, said guide means permitting angular and rotary adjustment of the axis of said distribution means with respect to an axis of said furnace;

at least three control elements connected to said distribution means at spatially displaced points;

actuating means for longitudinally moving said control elements to direct the discharge of said distribution means to selected positions in said furnace; and control means for independently regulating said actuating means in synchronism.

2. Apparatus for charging a shaft furnace as in claim 1 wherein:

said guide means defines a spherical surface about which said distribution means is movable.

3. Apparatus for charging a shaft furnace as in claim 2 wherein:

said distribution means is a cylindrical surface of revolution.

4. Apparatus for charging a shaft furnace as in claim 2 wherein:

said distribution means has a frustoconical interior lateral surface, with the major base thereof connected to said mounting means.

5. Apparatus for charging a shaft furnace has an intake chute for delivery of charge material to said distribution means;

said intake chute and said distribution means each having an axis, said axes intersecting at a point; said the center of the spherical surface defined by said guide means is at said point of intersection of said axes of said distribution means and said intake chute.

6. Apparatus for charging a shaft furnace as in claim 5 wherein:

said control elements are connected to said distribution means in the vicinity of the level of said point of intersection.

7. Apparatus for charging a shaft furnace as in claim 6 wherein said guide means includes:

a plurality of segments mounted on said intake chute, said segments being arranged in vertical planes passing through the axes of said intake chute.

8. Apparatus for charging a shaft furnace as is claim 7 wherein:

said plurality of segments is at least three.

9. Apparatus for charging a shaft furnace as in claim 1 including:

partition means in said furnace at said guide means, said partition means having apertures for passage of said control elements, and said partition means cooperating with upper wall portions of said furnace to define a chamber separate from the main body of the furnace.

10. Apparatus for charging a shaft furnace as in claim 9 including:

aperture means communicating with said chamber for the introduction of cooling and/or cleaning gas to said chamber.

11. Apparatus for charging a shaft furnace as in claim 1 wherein:

said actuating means includes at least three hydraulic jacks positioned outside of the furnace and spaced equidistantly apart about said furnace, one each of said hydraulic jacks being connected to one of said control elements; and including a pair of aperture means in each hydraulic jack for the admission and discharge of fluid for reciprocally operating each hydraulic jack;

said control means being operative to deliver hydraulic fluid alternately to each of said aperture means.

12. Apparatus for charging a shaft furnace as in claim 11 wherein said control means includes:

switchable valve means for alternately directing fluid to one of said aperture means and from the other of said aperture means;

electrical current responsive means for switching said valve means;

rotatable cam means; and first current varying means operably connected to said cam means to vary the current to said electrical current responsive means.

13. Apparatus for charging a shaft furnace as in claim 12 including:

second current varying means responsive means responsive to operation of an hydraulic jack to vary the current to said electrical current responsive means opposite to the current variation effected by said first current varying means.

14. Apparatus for charging a shaft furnace as in claim 13 wherein:

said first current varying means includes first rheostat means having a slide movable by said cam means, and said second current varying means includes rheostat means having a slide movable by the hydraulic jack.

15. Apparatus for charging a shaft furnace as in claim 13 including:

regulating valve means for controlling the flow of fluid to each hydraulic jack to control the speed of travel of the piston in the hydraulic jack.

16. Apparatus for charging a shaft furnace as in claim 12 wherein:

the rotatable cam means in each control means is mounted on a common rotatable shaft of adjustable speed.

17. Apparatus for charging a shaft furnace as in claim 11 wherein said control means includes:

valve means for alternately directing fluid to one of said aperture means and from the other of said aperture means;

means responsive to actuation of a hydraulic jack to produce a varying voltage signal;

level detecting means connected to receive said varying voltage signal for detecting first and second predetermined voltage levels;

logic means connected to said level detecting means and said valve means, said logic means having a first and second state commensurate with said first and second voltage levels to switch said valve means.

18. Apparatus for charging a shaft furnace as in claim 17 wherein:

said means to produce a varying voltage signal includes rheostat means having a slide connected to oscillate with movement of the piston of the hydraulic jack.

19. Apparatus for charging a shaft furnace as in claim 18 wherein:

movement of said slide is reversed when the varying voltage movement of said slide is reversed when the varying voltage signal equals said first and second levels.

20. Apparatus for charging a shaft furnace as in claim 19 including:

regulating means for controlling the flow of fluid to each hydraulic jack to vary the speed of travel of the piston in the jack.

21. Apparatus for charging a shaft furnace as in claim 1 including an intake chute for delivering charge to said distribution means and wherein said actuating means includes:

tiltable bearing means positioned about said intake chute and tiltable on a tilt axis perpendicular to said intake chute, said bearing means having a rotatable outer ring and a nonrotatable inner ring; and driving means for rotating said outer ring to pivot said bearing on said tilt axis;

said control elements being connected between said inner ring and said distribution means.

22. Apparatus for charging a shaft furnace as in claim 21 including:

guide means fixed to said intake chute and interacting with said inner ring to prevent rotation of said inner ring.

23. Apparatus for charging a shaft furnace as in claim 21 wherein:

each of said control elements includes a rod passing through an upper wall of said furnace, each rod being connected at one end by a universal joint to said inner ring; and further including:

link means connected between the other end of each rod and said distribution means.

24. Apparatus for charging a shaft furnace as in claim 23 including:

a plurality of swivel joint means in said upper wall of said furnace, each of said rods being slideably mounted in one of said swivel joint means.

25. Apparatus for charging a shaft furnace as in claim 21 wherein said driving means includes:

first motor means;

a rotatable cage drivingly connected to said first motor means, said cage being concentric with said intake chute, and said bearing means being tiltably mounted on said cage, whereby the angular position of said bearing may be varied during rotation of said cage; and adjustment means for varying the angular position of said bearing means independant of the rotation of said cage.

26. Apparatus for charging a shaft furnace as in claim 25 wherein:

rotation of said outer ring when said bearing is inclined with respect to the axis of said intake chute causes a synchronized longitudinal displacement of said control elements and a circular displacement of said distribution means about a vertical axis of the furnace.

27. Apparatus for charging a shaft furnace as in claim 33 wherein said adjustment means includes:

follower means connected to and extending from said outer ring;

second motor means; and means connecting said second motor means to act on said follower means to angularly adjust the position of said bearing means.

28. Apparatus for charging a shaft furnace as in claim 17 including:

means for adjusting said level detecting means to change said first and second predetermined voltage levels, whereby the switching of said valve means and the stroke of the hydraulic jack is changed.

29. Apparatus for charging a shaft furnace including:

tubular distribution means mounted in said furnace for distributing charge material to said furnace, said distribution means having an axis and inlet and discharge ends;

guide means in said furnace for supporting said distribution means for movement, said guide means permitting angular and rotary adjustment of the axis of said distribution means with respect to an axis of said furnace;

at least three control elements connected to said distribution means at spatially displaced points; and at least three hydraulic jacks positioned outside of the furnace and spaced equidistantly apart about said furnace, one each of said hydraulic jacks being connected to one of said control elements for longitudinally and synchronously moving said control elements to direct the discharge of said distribution means to selected positions in said furnace.

30. Apparatus for charging a shaft furnace as in claim 29 wherein:

said control elements are rigid rods connected between said distribution means and the pistons of the hydraulic jacks.

31. Apparatus for charging a shaft furnace as in claim 30 including:

a plurality of swivel joints in an upper wall of said furnace, each of said rigid rods being slideably mounted in a swivel joint.

32. Apparatus for charging a shaft furnace as in claim 30 including:

a plurality of swivel joints in an upper wall of said furnace, each of said rigid rods being slideably mounted in a swivel joint; and packing means in each of said swivel joints to slideably mount each rod in its swivel joint.

33. Apparatus for charging a shaft furnace as in claim 29 wherein:

said control elements are articulated linkages extending between said actuating means and said distribution means.

34. Apparatus for charging a shaft furnace as in claim 33 wherein:

said control elements are chains.

35. Apparatus for charging a shaft furnace as in claim 33 wherein said hydraulic jacks are rigidly mounted to the wall of the furnace.

36. Apparatus for charging a shaft furnace as in claim 29 wherein each of said control elements includes:

a rotary shaft passing through a wall of the furnace, said rotary shaft being operatively connected to one of said hydraulic jacks; and a crank and linkage connecting said rotary shaft to said distribution means.

37. Apparatus for charging a shaft furnace as in claim 36 wherein:

each of said hydraulic jacks is in a vertical plane parallel to an axis of the furnace.

* * * * *

UNITED STATES PATENT AND TRADEMARK OFFICE

CERTIFICATE OF CORRECTION

PATENT NO. : 4,042,130

DATED : August 16, 1977

INVENTOR(S) : Edouard Legille, et al

It is certified that error appears in the above-identified patent and that said Letters Patent are hereby corrected as shown below:

IN THE SPECIFICATION:

Column 4, line 8, "sener" should be --center--

Column 11, line 20, "known" should be --shown--

Column 15, line 51, "off" should be --of--

Column 16, line 1, "deiven" should be --driven--

IN THE CLAIMS:

Column 17, line 24, (Claim 5, line 1,) after "furnace" insert --as in claim 2 wherein:

said furnace--

UNITED STATES PATENT AND TRADEMARK OFFICE

CERTIFICATE OF CORRECTION

PATENT NO. : 4,042,130

DATED : August 16, 1977

INVENTOR(S) : Edouard Legille, et al

It is certified that error appears in the above-identified patent and that said Letters Patent are hereby corrected as shown below:

Column 17, line 28, (claim 5, line 5,) change "said" (second occurrence) to --and--

Column 18, lines 60 and 61 (claim 19, lines 3 and 4) cancel in their entirety

Column 19, line 52 (claim 27, line 2) change "33" to --25--

Signed and Sealed this

*Third* Day of *October 1978*

[SEAL]

*Attest:*

RUTH C. MASON
*Attesting Officer*

DONALD W. BANNER
*Commissioner of Patents and Trademarks*